US006761299B2

(12) United States Patent
Caringella et al.

(10) Patent No.: US 6,761,299 B2
(45) Date of Patent: Jul. 13, 2004

(54) MAGAZINE CLUTCH ASSEMBLY

(75) Inventors: Anthony R. Caringella, Norridge, IL (US); Michael S. Popovich, Bartlett, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/246,203

(22) Filed: Sep. 18, 2002

(65) Prior Publication Data

US 2004/0050900 A1 Mar. 18, 2004

(51) Int. Cl.[7] ..... B25C 1/14

(52) U.S. Cl. ..... 227/10; 227/119; 227/120; 227/136; 227/156

(58) Field of Search ..... 227/110, 119, 227/120, 130, 148, 128, 10, 136, 156

(56) References Cited

U.S. PATENT DOCUMENTS

| | | | | | |
|---|---|---|---|---|---|
| 1,977,382 | A | * | 10/1934 | Gruis | 227/115 |
| 2,801,415 | A | * | 8/1957 | Jenny | 227/130 |
| 3,451,606 | A | * | 6/1969 | Jacobson | 227/110 |
| 3,558,031 | A | | 1/1971 | Hillier | |
| 3,820,705 | A | * | 6/1974 | Beals | 227/113 |
| 3,891,133 | A | | 6/1975 | Maier et al. | |
| 4,072,261 | A | | 2/1978 | Livio | |
| 4,597,517 | A | | 7/1986 | Wagdy | |
| 4,741,467 | A | | 5/1988 | Gassner et al. | |
| 4,801,062 | A | | 1/1989 | Austin | |
| 4,903,880 | A | | 2/1990 | Austin et al. | |
| 5,842,625 | A | * | 12/1998 | Kimura | 227/127 |
| 6,059,162 | A | | 5/2000 | Popovich et al. | |
| 6,098,442 | A | | 8/2000 | Walldorf et al. | |
| 2001/0042768 | A1 | | 11/2001 | Lamb | |

FOREIGN PATENT DOCUMENTS

| | | | |
|---|---|---|---|
| GB | 847388 | * | 9/1960 |
| GB | 2 024 691 | | 12/1979 |

* cited by examiner

*Primary Examiner*—Rinaldi I. Rada
*Assistant Examiner*—Paul Durand
(74) *Attorney, Agent, or Firm*—Lisa M. Soltis; Mark W. Croll; Donald J. Breh

(57) ABSTRACT

A fastener driving tool has a tool body with an axis, a piston, a muzzle extending from tool body, and a magazine coupled to the muzzle. The fastener driving tool has an axial locking mechanism associated with a rotatable muzzle to releasably lock the muzzle and coupled magazine in at least one position. The axial locking mechanism comprises male members and female members with the male members biased axially into the female members.

10 Claims, 5 Drawing Sheets

MAGAZINE CLUTCH ASSEMBLY

BACKGROUND OF THE INVENTION

1. Field of the Invention

The present invention is directed to a fastener driving tool having a magazine that rotates around an axis and locks axially into a selected position.

2. Description of Related Art

A fastener driving tool typically has three regions: a back end enclosing a firing mechanism, a front end comprising a muzzle and a magazine, and an intermediate region comprising a tool body. A typical tool includes the tool body and a barrel housed coaxially within the tool body. The barrel contains and guides a piston, driven by the firing mechanism activated by a trigger. A buffer assembly in the barrel stops the flight of the piston. The muzzle, housed within a muzzle housing, extends forward from the tool body and is displaceable from an extended position into a ready-to-fire position when pressed against the receiving substrate.

Fastener driving tools desirably include a contact pressure safety feature assuring that the firing mechanism fires only when the muzzle is pressed against the receiving substrate. When pressed against the receiving substrate, the muzzle displaces into ready-to-fire position and enables the firing mechanism to fire when the trigger is pulled.

In some fastener driving tools, a magazine is coupled to the muzzle in order to minimize fastener loading time. Multiple fasteners, often connected in a assembly called a fastener strip, loaded into the magazine allow the user to fire multiple fasteners before needing to reload the tool. The magazine contains a follower that biases the fasteners toward the muzzle for driving by the piston into receiving substrate.

In many applications it is desirable to allow the muzzle and the magazine to rotate around a tool body axis so that an operator may move the magazine out of the way when driving fasteners into corners or other hard-to-reach places. Mechanisms that allow the magazine to rotate about the tool body axis are generally referred to as magazine clutches.

A magazine clutch must have a means to lock the magazine in place once a desired magazine position has been reached. If a locking mechanism is not employed, the magazine will flop around during operation and will be unwieldy. A prior magazine clutch locking assembly, as embodied in Hilti Model # DX351, locked the magazine in place using spring-biased bearings and receiving sockets to provide inwardly directed radial locking forces between the muzzle and the stator. This embodiment of the radial magazine locking mechanism made the tool bulky and cumbersome to handle.

What is needed is a non-bulky and easy-to-use magazine clutch assembly of a fastener driving tool.

BRIEF SUMMARY OF THE INVENTION

It is therefore an object of the present invention to provide a non-bulky and non-cumbersome locking mechanism that will releasably lock the muzzle and attached magazine in any selected one of predetermined positions.

In accordance with the present invention, a fastener driving tool comprises a tool body having an axis, a piston guided along the axis within the tool body, a muzzle extending forwardly from the tool body, a magazine coupled to the muzzle, and an axial locking mechanism associated with the muzzle. The muzzle and coupled magazine are rotatable around the tool body into at least one releasably locked position.

In another aspect of the invention, a barrel that guides a piston is housed coaxially within the tool housing. An annular stator is coaxial with the barrel, and the muzzle is rotatable with respect to the stator.

The axial locking mechanism comprises male members and female members, with the male members biased axially into the female members. The male members can be disengaged from the female members by application of a predetermined torque with respect to the muzzle. The bias of the male members may be provided by springs. In one embodiment, an axial locking mechanism comprises bearings and sockets, wherein the bearings are biased axially into the sockets.

DETAILED DESCRIPTION OF THE INVENTION

Figures 1, 2:
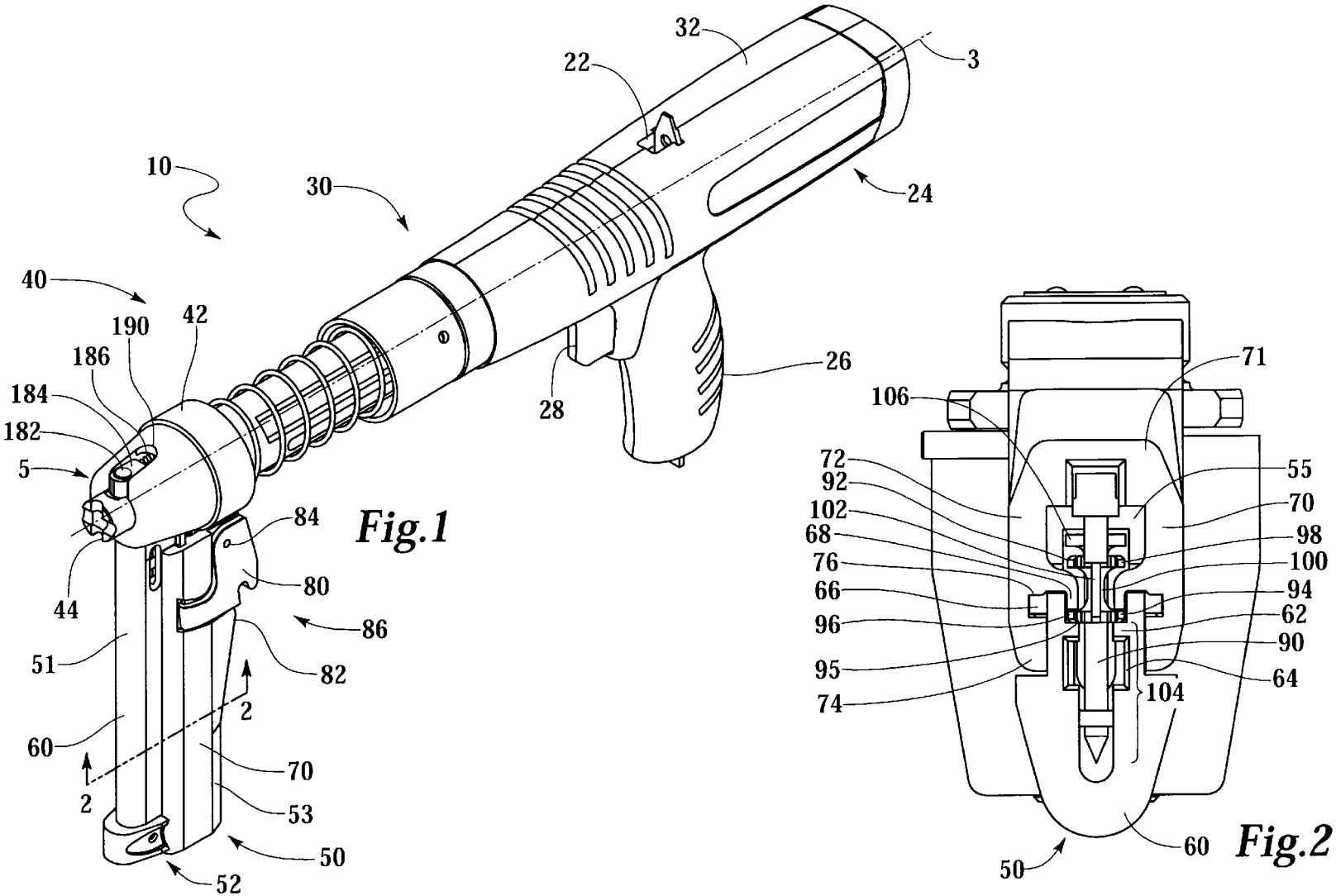
FIG. 1 is a perspective view of a fastener driving tool with a magazine for introducing fasteners into tool.
FIG. 2 is a bottom view of the magazine taken along the line 2—2 in FIG. 1.
Figures 4, 5, 6:
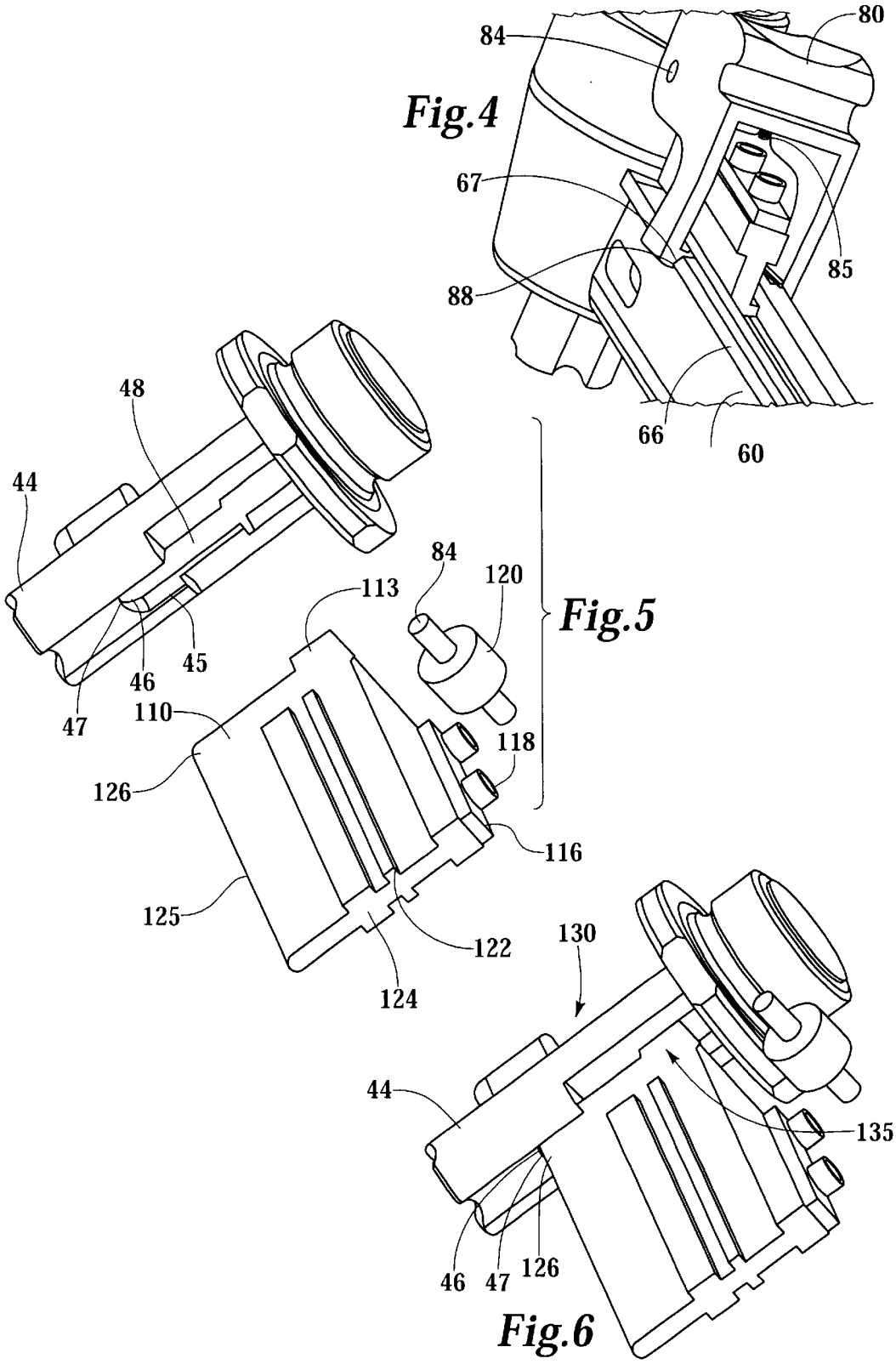
FIG. 4 is a partial view of the tool magazine with the slider removed.
FIG. 5 is a view of the muzzle, follower, and roll pin as they would be positioned within the magazine.
FIG. 6 is a view of muzzle, follower, and roll pin in muzzle lock-out position.
Figure 7:
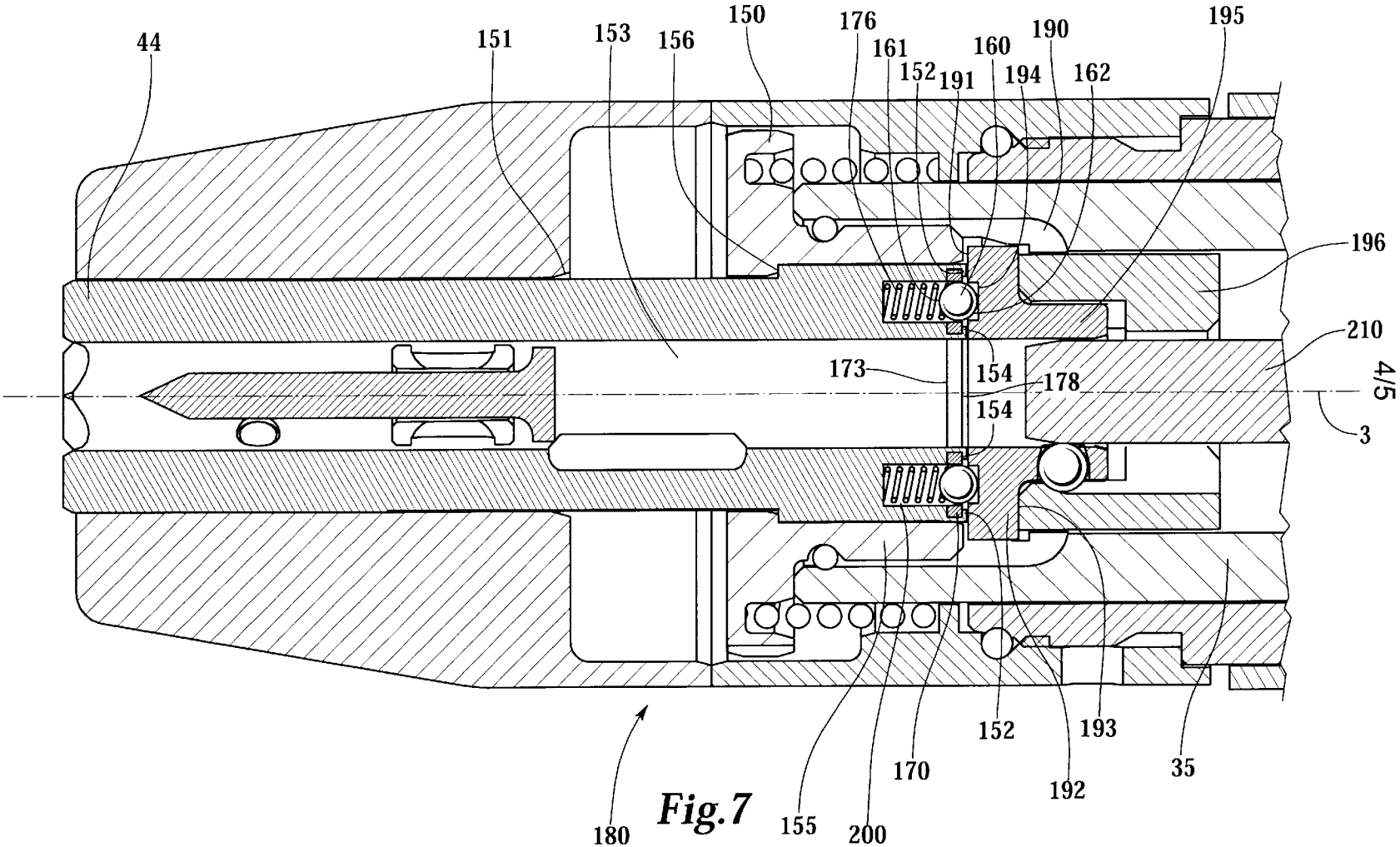
FIG. 7 is a side sectional of tool muzzle.

In FIG. 1, a novel fastener driving tool 10 is shown, having a magazine 50 with longitudinal guide member 68, see FIG. 2, an axially locking clutch mechanism 180, see FIG. 7, and a muzzle lock-out mechanism 130, see FIG. 6.

In FIG. 1, tool 10 has three regions: front end 40, back end 24, and intermediate region 30. Tool 10 includes tool body 32 with an axis 3, a powder cartridge opening 22, a back end 24 comprising a handle 26 and a firing mechanism 320, see FIG. 3, activated by a trigger 28, front end 40 comprising muzzle 44 housed within muzzle housing 42, and magazine 50 coupled to and extending laterally from muzzle 44.

In FIG. 2, novel longitudinal guide member 68 on magazine 50 guides fastener assembly 91 through magazine 50 and into muzzle 44. Longitudinal guide member 68 prevents fastener assembly 91 from skewing toward back end 24 of tool 10 and jamming magazine 50.

In FIG. 7, a magazine clutch assembly comprises a novel axial locking mechanism 180 that allows magazine 50 to pivot around tool body axis 3 and lock axially into one of the predetermined positions. In one embodiment, there are four predetermined positions. Axial locking mechanism 180 allows user to rotate magazine 50 out of the way when affixing fasteners 90 in room corners and other hard-to-reach places. Axial locking mechanism 180 provides a method for magazine 50 to pivot around tool body axis 3 while preventing tool 10 from becoming bulky and cumbersome.

In FIG. 6, novel muzzle lock-out mechanism 130 prevents tool 10 from firing when there are no fasteners 90 in magazine 50. Muzzle lock-out mechanism 130 prevents damage to tool 10 by preventing engagement of firing mechanism 320 when there are no fasteners 90 ready to be driven.

Orientation of tool 10 is as follows: front is in the direction of muzzle 44 and back is in the direction of back end 24.

Fastener Assembly

Figure 3:
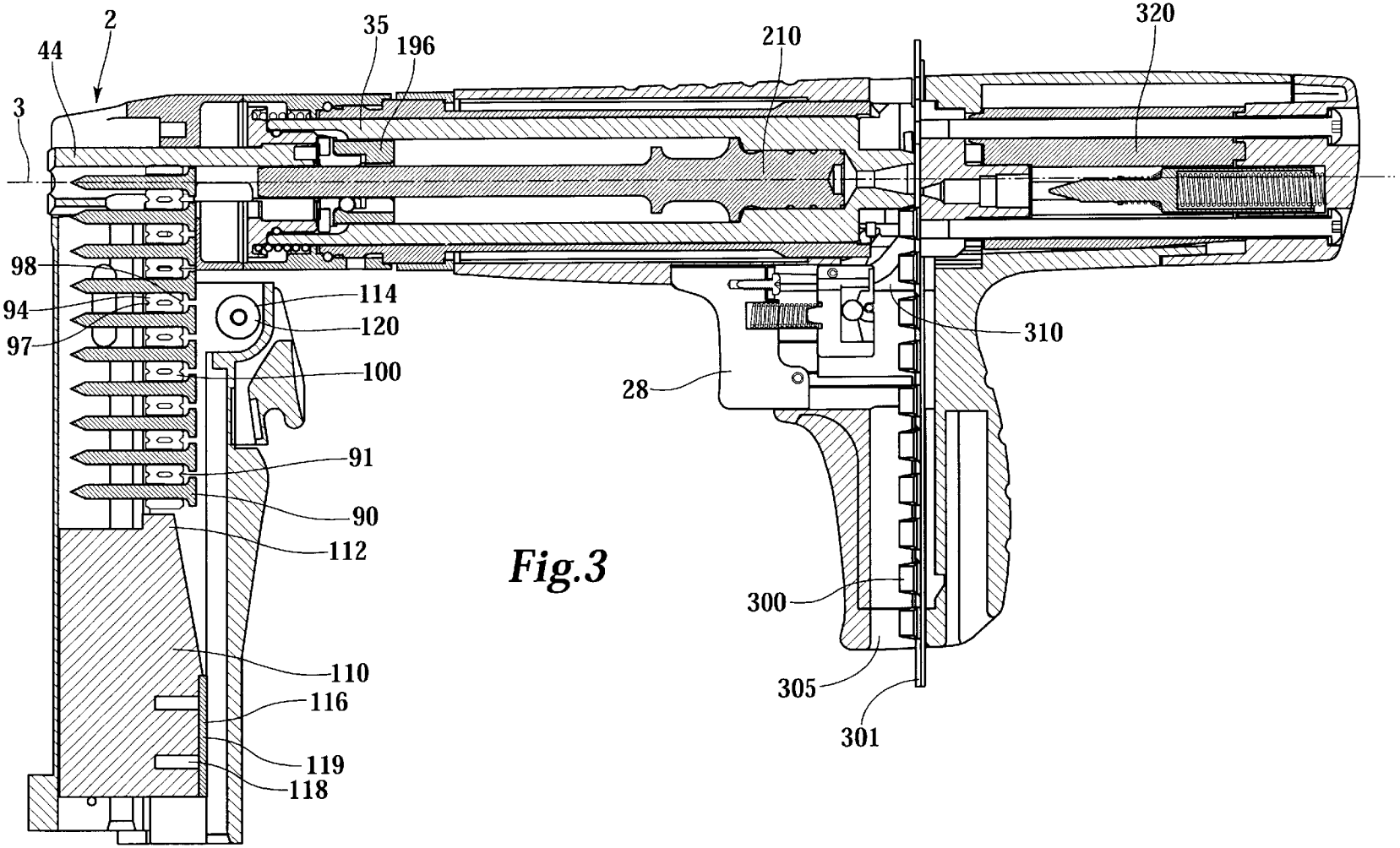
FIG. 3 is a side sectional view of tool and fastener strip.

A fastener assembly 91 comprising fasteners 90 joined in a strip is guided by magazine 50 toward muzzle 44 for driving by piston 210, as shown in FIG. 3. Returning to FIG. 2, magazine 50 houses and guides fastener assembly 91 that has a plurality of fasteners 90 joined together in a row by collation sleeves 100 having sleeve ridge 102 and two collars 92, head collar 98 and tip collar 94. Head collar 98 is proximate to fastener head portion 106, and tip collar 94 is proximate to fastener tip portion 104. Fasteners 90 are joined in assembly 91 by corresponding connections 97 between collars 92, see FIG. 3. The two fasteners 90 on ends of assembly 91 are each joined to only one other fastener. The rest of the fasteners 90 in assembly 91 are each joined to two other fasteners 90, one on each side.

Magazine

In FIG. 2, it is shown that magazine chamber 55 is defined by space enclosed between slider 70 and magazine housing 60. Fastener assembly 91 lies within magazine chamber 55.

As shown in FIG. 1, magazine 50 includes: slider 70, magazine housing 60, and latch 80 which keeps slider 70 in place in closed position 86. Magazine 50 houses fasteners 90 within magazine chamber 55 and feeds fasteners 90 toward muzzle 44. When latch 80 is depressed and slider 70 is moved to magazine end 52 of magazine housing 60, magazine chamber 55 is ready for loading of fastener assembly 91.

Continuing with FIG. 1, magazine housing 60 is the front section 51 of magazine 50 and is designed to contain fastener tip portion 104 of fastener assembly 91. Magazine housing 60 has a generally U-shaped cross-section and includes at least one, but preferably two, guiding ridges 62, which supports tip collars 94 of fastener assembly 91. Magazine housing 60 also has shoulders 66 that engages latch 80. Housing tip recess 64 is designed to allow at least one, but preferably two, follower guide members 124 through magazine housing 60, as shown in FIG. 5. Follower 110 must be correctly aligned in magazine chamber 55 in order to properly bias fastener assembly 91 toward muzzle 44.

As shown in FIG. 1, slider 70 is the section lying along the backside 53 of magazine 50 which can slide along magazine housing 60 from closed position 86 to magazine end 52. Slider 70 is designed to enclose fastener head portion 106 of fastener assembly 91, see FIG. 2.

Continuing with FIG. 2, slider 70 is a U-shaped piece of material with base 71 and two arms 72 extending laterally from base 71. Each arm 72 engages magazine housing 60 by slider lip 74 that slides along magazine housing 60. Each arm 72 also has two fingers 68 within magazine chamber 55 to ensure that tip collars 94 of fastener assembly 91 are correctly aligned, and not skewed, when inside magazine chamber 55.

Slider lip 74 has lip groove 76 that fits around shoulders 66 of magazine housing 60. Lip groove 76 keeps slider 70 engaged to magazine housing 60 and also ensures that slider 70 moves straight along magazine 50 when sliding from closed position 86 toward magazine end 52.

To ensure that fastener assembly 91 does not skew when inside magazine chamber 55, longitudinal guide member 68 is embodied in one embodiment as two fingers 68 lying on either side of said fastener 90. Fingers 68 extend from an inside surface of slider 70 and lie in a space between tip collar 94 and head collar 98 of collation sleeve 100 on fastener assembly 91. Fingers 68 extend perpendicularly from a section of slider 70 located between tip collar 94 and head collar 98 and then curve toward tip collar 94, running parallel to fastener 90, approximately a collar width away from fastener 90. Fingers 68 extend toward back edge 96 of tip collar 94 and end 0.030 inch from back edge of the tip collar when front edge 95 of tip collar 94 lies flush against guiding ridge 62 of magazine housing 60, thus preventing fastener assembly 91 from skewing more than 0.030 inch backwards when inside magazine 50.

Thus, it can be seen that improved tool 10 has magazine 50 with stabilizing members 68. Improved fastener driving fastener driving tool 10 has tool body 32 with axis 3, muzzle housing 42 extending forwardly from tool body 32, and muzzle 44 housed within and extending forwardly from muzzle housing 42.

In order to minimize fastener 90 loading time, tool 10 also has magazine 50 for holding fastener assembly 9 1, with magazine 50 having slider 70 and magazine 50, follower 10 located in magazine 50 arranged to bias fasteners 90 through magazine 50 into muzzle 44. Fastener assembly 91 is held in magazine chamber 55 defined by slider 70 and magazine housing 60, wherein slider 70 is engageable to magazine housing 60 and moves from closed position 86 to magazine end 52. Slider 70 has longitudinal guide member 68 that guides fastener assembly 91 through magazine 50 toward muzzle 44 and prevents fastener assembly 91 from skewing and jamming magazine 50.

Latch 80 is attached to slider 70 and allows slider 70 to easily move from a locked closed position 86 to magazine end 52 so that fastener assembly 91 can be placed within magazine chamber 55.

In the preferred embodiment, magazine housing 60 is front section 51 of magazine 50 and slider 70 is backside 53. User can depress latch 80 and pull slider 70 to magazine end 52 and load new fastener assembly 91 while keeping tool 10 oriented toward receiving substrate.

Fastener Loading

Referring to FIG. 1, Slider 70 must move toward magazine end 52 to leave magazine chamber 55 open for loading fastener assembly 91. Latch 80 keeps slider 70 locked in closed position 86. Latch 80 runs across cut out 82 on slider 70.

As shown in FIG. 4, cut out 82 enables latch foot 88 on latch 80 to engage shoulder 66 by fitting into shoulder notch 67. Latch 80 is pivotally attached to slider 70 by roll pin 84 and is biased backwards by spring 85, causing latch foot 88 to engage shoulder notch 67. In closed position 86, latch foot 88 fits within shoulder notch 67 and abutment of shoulder notch 67 and latch foot 88 keeps slider 70 from sliding from closed position 86 toward magazine end 52.

Still referring to FIG. 4, when latch 80 is depressed, latch 80 moves forwardly away from shoulder 66. Latch foot 88 no longer abuts shoulder notch 67, leaving latch 80 free to move towards magazine end 52. Since latch 80 is attached to slider 70 by roll pin 84, when latch 80 moves, slider 70 is pulled along.

Returning to FIG. 2, slider 70 slides to magazine end 52, guided by shoulder 66 and lip groove 76, leaving magazine chamber 55 open for loading of fastener assembly 91. Fastener assembly 91 is loaded into magazine chamber 55 by placing tip portion 104 within magazine housing 60 and until front edge of tip collar 94 contacts guiding ridge 62 of magazine housing 60. User then slides slider 70 along magazine 50 to closed position 86, enclosing fastener head portion 106, guided by shoulder 66 and complementary lip groove 76, so that fingers 68 are positioned 0.030 inch above back edge of fastener 90 tip collar 94. Fingers 68 assume correct position for guiding fastener assembly 91 when user slides slider 70 into closed position 86. User does not need to expend any extra time aligning fingers other than time necessary to close magazine chamber 55 by sliding slider 70 from magazine end 52 to closed position 86.

Follower

In FIG. 3, follower 110 within magazine 50 biases fastener assembly 91 toward muzzle 44. Follower protrusion 112 abuts sleeve ridge 102 of fastener 90 lying closest to muzzle end 52 on fastener assembly 91 within magazine 50. As follower 110 is biased toward muzzle 44 by coiled constant pressure spring 114, fastener assembly 91 is pulled toward muzzle 44.

In FIG. 5, there is collar ridge 122 and follower guide member 124 that keep follower 110 correctly aligned within magazine chamber 55. At least one collar ridge 122, but preferably two, follows the path of tip collars 92 of fastener assembly 91 by moving through a space between guiding ridge 62 on magazine housing 60 and stabilizing finger ridge 68 on slider 70. At least one, but preferably two, follower guide member 124 fits through space created by housing ridge recess 64 on magazine housing 60, as shown in FIG. 2. Collar ridges 122 and follower guide members 124 ensure that follower 110 is properly guided through magazine chamber 55 in order to properly bias fasteners 90 into muzzle 44.

In FIG. 3, coiled constant pressure spring 114 biases follower 110 toward muzzle 44. One end of constant pressure spring 114 is connected to back edge 119 of follower 110 by plate 116 and screws 118. Other end of constant pressure spring 114 is coiled around bushing 120 in slider 70, as seen in FIG. 3. Bushing 120 fits around latch roll pin 84. After fastener assembly 91 is loaded into magazine chamber 55 and slider 70 slides into closed position 86, follower 110 remains at magazine end 52 due to fastener assembly 91 being in magazine chamber 55. Constant pressure spring 114 exerts force on follower 110 biasing follower 110 and fastener assembly 91 toward muzzle 44. As fasteners 90 are driven out of muzzle 44 and fastener assembly 91 grows shorter, constant pressure spring 114 increasingly coils around bushing 120 pulling follower 110 toward muzzle 44, thus biasing fastener assembly 91 toward muzzle 44.

Magazine 50 of tool 10 includes a latch 80 and a constant pressure spring 114. Latch 80 allows slider 70 to be easily locked into closed position 86, in addition to allowing user to easily move slider 70 to magazine end 52 by sliding latch 80, with attached slider 70, along magazine housing 60 to magazine end 52.

Follower 110 is connected to slider and moves within magazine chamber 55 to magazine end 52 when latch 80 is depressed and pulled to magazine end 52. When fastener assembly 91 is introduced into magazine chamber 55, slider 70 slides to closed position 86 while follower 110 remains properly positioned at magazine end 52 within magazine chamber 55 to bias fastener assembly 91 toward muzzle 44.

Coiled constant pressure spring 114 applies a uniform pressure to fastener assembly 91 so fasteners 90 are fed by an even force into muzzle 44 and fastener 90 will always be properly positioned within muzzle 44. The presence of fastener assembly 91 within magazine chamber 55 forces coiled constant pressure spring 114 to uncoil when slider 70 is moved from magazine end 52 along magazine housing 60 to closed position 86. Coiled constant pressure spring 114 is automatically properly arranged to bias fastener assembly 91 when slider 70 is slid to closed position 86. Coiled constant pressure spring does not need to be individually locked and arranged during fastener loading, thus saving time during fastener loading.

Lock-out Mechanism

Turning to FIG. 6, when all fasteners 90 have been driven out of muzzle 44, tool 10 lies in fastener-empty condition 135. Lock-out mechanism 130, ensures that tool 10 does not fire during fastener-empty condition 135 by preventing muzzle 44 from moving into ready-to-fire position 2. Tool 10 should not fire when there are no fasteners 90 in magazine 50 or buffer assembly 190, as seen in FIG. 7, and follower 110 may be damaged by free-flight of piston 210, as seen in FIG. 3.

As shown in FIG. 6, all fasteners 90 have been driven out of muzzle 44 and tool 10 is in fastener-empty condition 135. Follower 110 fits through opening 48 in muzzle wall 45 with fastener-contacting portion 113 lying within muzzle 44. Lock-out mechanism 130 includes a stop 46 formed by muzzle wall surface 47, made accessible by muzzle wall opening 48, abutting blocking surface 126 of follower 110.

Front surface 125 of follower 110 provides blocking surface 126. Exposed surface 47 of muzzle wall 45 comes into contact with front surface 125 of follower 110 when muzzle 44 is pressed against receiving substrate during fastener-empty condition 135. Since follower 110 does not displace in the axial direction, the contact with front surface 125 of follower 110 prevents muzzle 44 from assuming ready-to-fire position 2, when muzzle 44 is flush with muzzle housing 42, as seen in FIG. 3.

Improved muzzle 44 and follower 110 allows for a direct muzzle lock-out mechanism 130 on tool 10 preventing firing during fastener empty condition 140. Direct muzzle lock-out mechanism 130 assures that muzzle 44 will not be in ready-to-fire position 2, piston 210 will not fire, and tool 10 will not be damaged by piston 210 during fastener-empty condition 2, see FIG. 3.

Referring back to FIG. 1, fastener driving tool 10 has tool body 32, muzzle housing 42 extending forwardly from tool body 32, and muzzle 44 extending forwardly from muzzle housing 42 with muzzle 44 being displaceable into ready-to-fire position 2, see FIG. 3. Tool 10 includes magazine 50 coupled with muzzle 44 and extending laterally from muzzle 44. A follower 110 is located in magazine 50 to bias fasteners 90 through magazine 50 into muzzle 44. Follower 110 has a fastener-contacting portion 112 and a blocking surface 126. When all fasteners 90 have been fed through magazine 50 into muzzle 44 and driven out of muzzle 44 by piston 210, as seen in FIG. 3, blocking surface 126 blocks muzzle 44 when magazine 50 is in fastener-empty condition 135 and prevents muzzle 44 from being displaced into ready-to-fire position 2. Tool 10 will not fire when muzzle 44 is blocked from assuming ready-to-fire position 2 thus preserving tool 10 from damage by free-flight of piston 210.

Magazine Clutch

In FIG. 7, a magazine clutch is formed by an axial locking mechanism 180 associated with muzzle 44 which is part of muzzle assembly 140. Axial magazine clutch 180 provides a means for axially locking muzzle assembly 140 in place relative to a barrel 35 with axial locking forces so that muzzle assembly 140 and coupled magazine 50 cannot rotate around tool body axis 3 without the operator providing an adequate disengaging torque with respect to muzzle assembly 140.

Axial locking mechanism 180 is accomplished by male members fitting into female members. In a preferred embodiment, male members are spring-biased ball bearings 170 protruding out the back of muzzle assembly 140. Preferred female members are sockets 194 on retention plate 192 of buffer assembly 190.

Axial locking mechanism 180 allows magazine 50 on fastener driving tool 10 to rotate around tool body axis 3 while keeping tool non-bulky. Rotating magazine 50 to one of selected four predetermined positions allows user to position tool to properly drive fasteners into room corners and other hard-to-reach places. An axial locking mechanism 180 allows magazine 50 to rotate around tool body axis 3 while keeping tool body 32 from getting too large in girth and becoming cumbersome and unwieldy.

Fastener driving tool 10 having axial locking mechanism 180 has tool body 32 with axis 3, barrel 35 housed coaxially within that houses and guides piston 210. Buffer assembly 190 has retention plate 192 and is housed within barrel 35 to control flight of piston 210. Muzzle housing 42 extends forwardly from tool body 32, and stator 150 is coaxially connected to barrel 35 and extends forwardly from barrel 35. Muzzle assembly 140 is rotatably connected to stator 150 and extends through and forwardly from muzzle housing 42. Magazine 50 holds fastener assembly 91 and is coupled to muzzle assembly 140 at one end and extends laterally from muzzle assembly 140. Magazine 50 and muzzle assembly 140 are rotatable around tool body axis 3 to a predetermined number of releasably locked positions. Axial locking mechanism 180 releasably locks muzzle assembly 140 and coupled magazine 50 in one of predetermined releasably locked positions through engagement of muzzle assembly 140 with buffer assembly 190.

Muzzle Assembly

In FIG. 7, axial locking mechanism 180 is associated with muzzle assembly 140 and acts to provide axially locking forces between muzzle assembly 140 and retention plate 192 on retention cage 195 of buffer assembly 190 in barrel 35.

Axial locking mechanism 180 is associated with muzzle assembly 140 that includes muzzle 44, having front end 41 and back end 43, connected to magazine 50 and extending through and forwardly from muzzle housing 42. Backplate 170, has front surface 173, back surface 178, and holes 172, swedged against back side 43 of muzzle 44. There are channels 200 running in the axial direction in back side 43 of muzzle 44. Springs 176 housed within channels 200 in muzzle 44, ball bearings 160, each having front surface 161 and back surface 162, that are biased by springs 176 in direction of backplate 170. Springs 176 in channels 200 bias ball bearings 160 against holes 172 in backplate 170, and ball bearings 160 are retained by backplate 170 with back surfaces 162 of ball bearings 160 facing out of back surface 178 of backplate 170. Retention plate 192 of buffer assembly 190 has sockets 194 to receive back surfaces 162 of ball bearings 160.

User can assemble muzzle assembly 140 separately from tool 10 and then insert muzzle assembly 140 into tool 10. Muzzle assembly 140 pieces do not have to be inserted into tool body 32 and properly positioned within tool body 32. Tool assembly and repair work is much easier with muzzle assembly 140.

Figure 8:
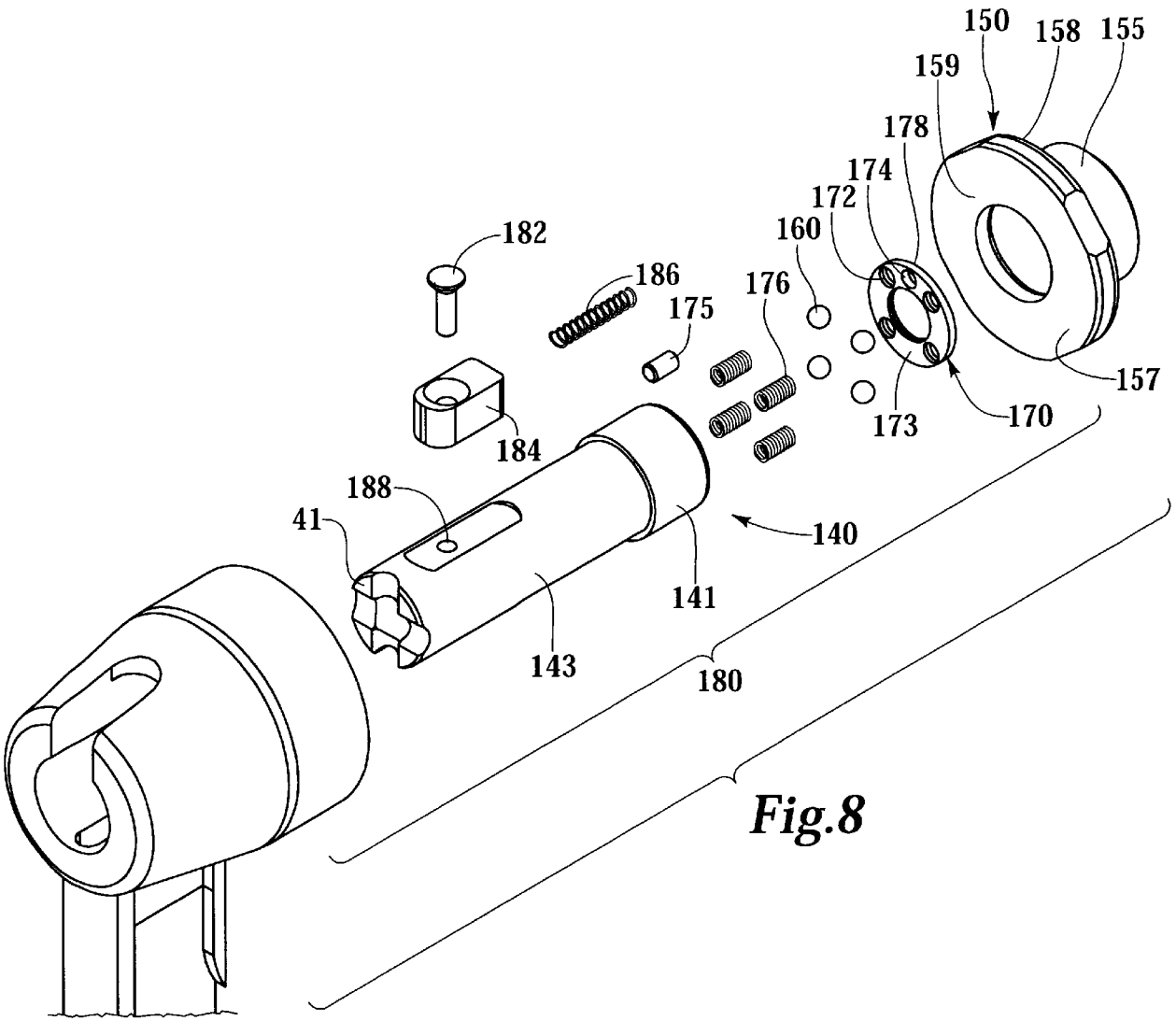
FIG. 8 is an exploded view of muzzle assembly.

As shown in FIG. 8, muzzle assembly 140 extends through and forwardly from muzzle housing 42 and is held in place by key 184 and screw 182. Muzzle 44 includes a front end 41 and a back end 43, with an annular shoulder 141 located generally at back end and a main portion 143 axially extending forwardly away from annular shoulder 141. The outer diameter of shoulder 141 is slightly larger than outer diameter of main portion 143, so that shoulder 141 extends radially outward from main portion 143.

As shown in FIG. 7, back end 43 of muzzle 44 has four axial channels 200 spaced equidistantly 90 degrees from each other, which house springs 176. There is axial pin channel 204 lying directly in the middle of two channels 200.

Backplate 170 that has a front surface 173 and a back surface 178, and lies in back of muzzle shoulder 141. Backplate 170 has five holes, slightly smaller than 0.156 inch in diameter, with four holes 172 spaced equidistantly 90 degrees from each other, and a fifth hole, pin hole 174, lying directly in the middle of two holes on backplate 170. Four equidistantly spaced holes 172 are designed to retain ball bearings 160, as described below.

Continuing with FIG. 7, backplate 170 is swedged with outer swedge 152 and an inner swedge 154 into muzzle 44 to lock backplate 170 to muzzle 44. Outer swedge 152 runs along outer rim 151 of backside 43 of muzzle 44 and interior swedge 154 runs along interior rim 153. Front surface 173 of backplate 170 is held against back side 43 of muzzle 44 and oriented so that pin hole 174 lines up with pin channel 204. Pin 175 runs through pin hole 174 and fits into pin channel 204 in muzzle 44 to ensure backplate 170 remains in proper alignment against back of muzzle 44.

Four springs 176 are placed in channels 200, one spring in each channel, to bias ball bearings 160 against holes 172 on backplate 170 and into four sockets 194 on retention plate 192, as described below. In the preferred embodiment, the spring is 0.148 inch OD, 5/16 inch long.

Four ball bearings 160 are biased against backplate 170 by springs 176 and retained by four holes 172. In the preferred embodiment, ball bearings are 0.156 inch (5/32) chrome steel bearings, part #9528K12 from McMaster Carr. Back surfaces 162 of ball bearings 160 face out back side 178 of backplate 170, thus comprising the male members of axial locking mechanism 180.

Buffer Assembly

In FIG. 7, buffer assembly 190 contains sockets 194 which comprise the female members of axial locking mechanism 180. Buffer assembly 190 is a two-part system that stops the flight of a piston 210, as shown in FIG. 3, during fastener driving. Buffer assembly 190 comprises retention cage 195 and buffer body 196. Retention cage 195 has an annular retention plate 192, having front surface 191 and back surface 193. Front surface 191 of retention plate 192 has four sockets 194 spaced equidistantly 90 degrees from each other. Back surface 193 of retention plate 192 abuts buffer body 196.

Back surfaces 162 of four ball bearings 160 on muzzle assembly 140 fit into four equidistantly spaced sockets 194 on front surface 191 of retention plate 192 when in one of four predetermined positions. Four sockets 194 are hemispherically indented and slightly less than 0.156 inch in diameter.

Magazine Clutch Mechanism

Engagement between each of four ball bearings 160 on muzzle assembly 140 and each of four sockets 194 on front surface 191 of retention plate 192 provide axial locking mechanism 180 for holding muzzle assembly 140 and coupled magazine 50 in one of four predetermined number of positions around tool body axis 3. Springs 176 exert a force against ball bearings 160 to require a disengaging torque between 3 and 6 inch-pounds, enough torque to keep muzzle assembly 140 and coupled magazine 50 in place during tool 10 operation, but not too much torque to prevent operator from moving muzzle assembly 140 and coupled magazine 50 at will.

Preferably, muzzle assembly 140 is put together as a subassembly before mounting same into tool 10, for improved manufacture, repair and operation.

Muzzle and Stator Assembly

In FIG. 7, muzzle assembly 140 is rotatably housed within stator 150 so that muzzle assembly 140 with coupled magazine 50 can rotate around tool body 32 axis in a stationary tool body 32 and stationary coaxial barrel 35.

Muzzle 44 is rotatably connected to stator 150 and stator 150 is connected to barrel 35. Stator 150 is generally annular in shape, while muzzle assembly 140 is generally cylindrical in shape having an outer diameter that is slightly smaller than an inner diameter of the annulus of stator 150 so that muzzle assembly 140 fits within stator 150.

As seen in FIG. 8, stator 150 includes a front side 157 and a back side 158, with an annular flange 159 located generally at front side 157, and a cylindrical portion 155 extending axially backwardly away from flange 159. Stator 150 has a bore 156. Muzzle shoulder 141 fits radially within bore 156 of stator 150. Main portion 143 of muzzle 44 fits within stator 150 within a predetermined tolerance so muzzle 44 can rotate.

Front end of muzzle 44 is inserted into bore 156 from back side of stator 150. Muzzle 44 is pulled forwardly through stator 150 until front surface of shoulder 141 engages back surface of cylindrical portion 155 on stator 150 so that muzzle 44 cannot be moved in the driving direction any more relative to stator 150. Stator 150 holds muzzle 44 in place axially while allowing magazine 50 coupled with muzzle 44 to rotate around tool body axis 3 to let user better position tool 10 for driving fasteners 90 in hard-to-reach places

Magazine Compression Safety Feature

In order for tool 10 to fire, muzzle 44 must be displaced to ready-to-fire position 2, where muzzle 44 is flush against muzzle housing 42, see FIG. 3, by pressing muzzle 44 against receiving substrate. Safety mechanism 5 as seen in FIG. 1, prevents user from putting tool 10 in ready-to-fire position 2 simply by simply pulling back on magazine 50. Muzzle 44 must be pressed against substrate in order to place tool 10 in ready-to-fire position 2.

Key 184 is screwed into muzzle key hole 188 by screw 182. Spring 186 is housed within channel 190 in muzzle housing 42. Spring 186 biases key 184 toward front end 40 of tool 10. Muzzle 44 cannot displace unless muzzle 44 is pressed against receiving substrate. Simply pulling back on magazine 50 will not put muzzle 44 in ready-to-fire position 2 because spring 186 biases key 184 which is attached to muzzle 44, preventing displacement into ready-to-fire position 2.

Cartridge Firing Mechanism

As seen in FIG. 3 fastener driving tool 10 fires by having explosive powder charge cartridges 300 ignited by firing mechanism 320. In order to allow a plurality of explosive powder cartridges 300 to be fed to tool 10, cartridges 300 are arranged on a cartridge strip 301 which is fed to a firing mechanism 320 along a cartridge channel 305. It is desirable for tool 10 to include an advancing mechanism (not shown) for indexing cartridge strip 301 after tool 10 has been fired so that the spent cartridge 300 can be moved away from firing mechanism 320 and a fresh cartridge 300 can be fed to firing mechanism 305. It is still more desirable for the advancing mechanism to index cartridge strip 302 automatically after tool 10 has been fired.

An example of a cartridge firing mechanism is disclosed in the commonly assigned patent application Ser. No. 10/246,261 entitled "Cartridge Strip Advancing Mechanism For Fastener Driving Tool" as incorporated by reference.

Tool Operation

Tool 10 put in use by first loading fastener assembly 91 into magazine chamber 55, as described in detail above, then closing magazine chamber 55 by sliding slider 70 into closed position 86. Muzzle 44 must be pressed against substrate so that muzzle 44 assumes ready-to-fire position 2. The user must then pull trigger 28 to activate firing mechanism. Firing pin hits cartridge 300, igniting cartridge 300 and resulting combustion drives piston 210. Piston 210 displaces forwardly in barrel 35 and hits head 106 of fastener 90 on fastener assembly 91 and drives fastener 90 out of muzzle 44 and into substrate.

When driving fasteners into hard-to-reach places, user can rotate magazine 50 by applying force to magazine end 52 and utilizing clutch mechanism 180. When all fasteners 90 have been biased through magazine 50 and driven into substrate, user cannot fire tool 10 because muzzle 44 will not displace into ready-to-fire position 2 when user presses tool 10 against substrate due to muzzle lock-out mechanism 130.

In summary, it can be seen that a fastener driving tool 10 has novel longitudinal guide member 68 on magazine 50 that guides fastener assembly 91 through magazine 50 and into muzzle 44 that prevent fastener assembly 91 from skewing toward back end 24 of tool 10 and jamming magazine 50. Another novel feature of the tool is an axial clutch mechanism 180 that allows magazine 50 to pivot around the tool body axis 3 and lock axially into one of four predetermined positions to let user position tool 10 properly when affixing fasteners in corners and other hard-to-reach places. Another novelty of the tool is a muzzle lock-out mechanism 130 that prevents tool 10 from firing when there are no fasteners 90 in magazine 50 by having follower 110 block muzzle 44 from moving into ready-to-fire position 2 when there are no fasteners 90 ready to be driven.

What is claimed is:

1. A fastener driving tool, comprising:

a tool body having an axis;

a piston guided along said axis within said tool body;

a muzzle mounted within a muzzle housing, said muzzle extending forwardly from said tool body along said axis;

a magazine coupled to said muzzle housing;

an axial locking mechanism associated with said muzzle;

wherein said muzzle housing and said coupled magazine are rotatable around said tool body axis into at least one releasably locked position.

2. A fastener driving tool, as set forth in claim 1, further comprising a barrel housed coaxially within said tool body, wherein said barrel houses and guides said piston.

3. A fastener driving tool, as set forth in claim 2, further comprising an annular stator coaxial with said barrel, wherein said muzzle is rotatable with respect to said stator.

4. A fastener driving tool, as set forth in claim 3, wherein said axial locking mechanism comprises bearings and sockets, and wherein said bearings are biased axially into said sockets.

5. A fastener driving tool, as set forth in claim 3, wherein said axial locking mechanism comprises male members and female members, and wherein said male members are biased axially into said female members.

6. A fastener driving tool, as set forth in claim 5, wherein said male members are disengageable from said female members by application of a predetermined torque with respect to said muzzle.

7. A fastener driving tool, as set forth in claim 5, wherein said bias of said male members is provided by springs.

8. A fastener driving tool, comprising:

a tool body having an axis;

a piston guided along said axis within said tool body;

a retention plate housed within said tool body, said retention plate having a plurality of sockets;

a stator coaxially connected to said tool body, said stator having a bore;

a muzzle assembly extending forwardly from said tool body along said axis said muzzle assembly including:

a muzzle rotatably housed within said bore of said stator, said muzzle having a back end;

a plurality of springs housed at said back end of said muzzle;

a back plate mounted at said back end of said muzzle for retaining a set of bearings;

wherein said springs bias said bearings into said sockets;

said muzzle assembly being mounted within a muzzle housing;

a magazine coupled to said muzzle housing;

wherein said bearings are disengageable from said sockets by application of a predetermined torque so that said muzzle housing and said coupled magazine are rotatable around said tool body axis into at least one releasably locked position.

9. A fastener driving tool, as set forth in claim 8, wherein said stator includes a flange at a front side of said stator extending radially inwardly into said stator bore, wherein said muzzle further comprises a shoulder proximate said back end extending radially outwardly, wherein said shoulder engages said flange of said stator.

10. A fastener driving tool, as set forth in claim 8, wherein said back plate is mounted to said muzzle by swedging.

* * * * *